US007931539B2

(12) United States Patent
Chen

(10) Patent No.: US 7,931,539 B2
(45) Date of Patent: Apr. 26, 2011

(54) ELEVATING MECHANISM AND FERRIS WHEEL USING THE SAME

(76) Inventor: Shin-Guang Chen, Taipei (TW)

( * ) Notice: Subject to any disclaimer, the term of this patent is extended or adjusted under 35 U.S.C. 154(b) by 108 days.

(21) Appl. No.: 12/461,221

(22) Filed: Aug. 5, 2009

(65) Prior Publication Data

US 2010/0234119 A1 Sep. 16, 2010

(30) Foreign Application Priority Data

Mar. 16, 2009 (TW) ..... 98108399 A

(51) Int. Cl.
*A63G 1/44* (2006.01)
*A63G 27/00* (2006.01)

(52) U.S. Cl. ..... 472/2; 472/45; 472/131; 187/250

(58) Field of Classification Search ..... 472/2, 39, 472/44–45, 50, 131, 134; 187/250, 251, 187/285, 404, 405
See application file for complete search history.

(56) References Cited

U.S. PATENT DOCUMENTS 3,120,880 A * 2/1964 Jaseph ..... 187/254
4,988,089 A * 1/1991 Knijpstra ..... 472/3
5,628,690 A * 5/1997 Spieldiener et al. ..... 472/131
5,704,841 A * 1/1998 Checketts ..... 472/131
5,989,127 A * 11/1999 Kitchen et al. ..... 472/44
6,001,022 A * 12/1999 Spieldiener et al. ..... 472/131
6,629,895 B2 * 10/2003 Uemura et al. ..... 472/60
6,758,309 B2 * 7/2004 O'Donnell et al. ..... 187/259

* cited by examiner

*Primary Examiner* — Kien T Nguyen
(74) *Attorney, Agent, or Firm* — Bacon & Thomas, PLLC

(57) ABSTRACT

An elevating mechanism includes a cage, a connecting element, a balancing weight body, a sheave and a power output unit. The cage includes an outer box and an inner box. The outer box for containing a fluid has an inlet and an outlet. The inlet is for the fluid flowing into the outer box. The outlet is for the fluid flowing out of the outer box. The inner box is placed inside the outer box for containing a loading body, and suspended in the fluid. The connecting element is wound around the sheave. The power output unit is for driving the sheave. One end of the connecting element is connected to the outer box, and the other end connected to the balancing weight body. The weight of the balancing weight body is equal to the total weight of the outer box, the fluid, the inner box and the loading body.

18 Claims, 3 Drawing Sheets

ELEVATING MECHANISM AND FERRIS WHEEL USING THE SAME

BACKGROUND OF THE INVENTION (1) Field of the Invention

The invention relates to an elevating mechanism, and especially relates to an elevating mechanism having the counterweight regulated mechanism.

(2) Description of the Prior Art

Refer to FIG. 1, the conventional elevating mechanism 100 includes a cage 120, a sheave 140, a counterweight 160 and a cable 180. The cable 180 is wound around the sheave 140 and two ends of the cable 180 separately hang down from two sides of the sheave 140. The cage 120 and the counterweight 160 are separately connected to two ends of the cable 180. Otherwise, the elevating mechanism 100 usually has a support component 190 for supporting the sheave 140 and the cable 180. As FIG. 1 showing, the support component 190 upholds the cable 180, which is disposed at right side of the sheave 140, to increase the distance D between two ends of the cable 180 separately at two sides of the sheave 140 and to avoid the cage 120 colliding with the counterweight 160 when the elevating mechanism 100 operating.

In the conventional technology, the weight of the counterweight 160 is a half of the weight of the loading body 200 of the outer box 120. For example, the maximum loading weight of the elevating mechanism 100 is 1000 KG, so the counterweight 160 should be 500 KG.

When the weight M of the loading body 200 such as goods or staffs is below 1000 KG, the power of the elevating mechanism 100 is (|M−500|+A)*P(KW/KG), where M denotes the weight (KG) of the loading body 200, A denotes the friction (KG) of the sheave 140, and P denotes the power (KW) consumed with per kilogram(KG). For example, when the weight of the loading body 200 is just 500 KG, the elevating mechanism 100 achieves the most frugal state; otherwise, when the weight of the loading body 200 is not 500 KG, the elevating mechanism 100 is unable to achieve the most frugal state.

Above all, the conventional elevating mechanism 100 is in the absence of the counterweight regulated mechanism, so whole weight of the cage 120 or the counterweight 160 is unable to be adjusted with variety weight of the loading body 200 to make the elevating mechanism 100 keep the most frugal state. Therefore, without the counterweight regulated mechanism, the cage 120 is able to be in the danger of rush, for example, when M<500 KG and the brake of the elevating mechanism 100 is failure, the cage 120 is able to rush up; when M>500 KG and the brake of the elevating mechanism 100 is failure, the cage 120 is able to rush down.

SUMMARY OF THE INVENTION

Accordingly, the object of the invention is to provide an elevating mechanism saving the power better than the conventional and solving the problem of rush.

In one aspect, the invention provides an elevating mechanism including a cage, a connecting element, a counterweight, a sheave and a power output unit. The cage has an outer box and an inner box. The outer box is for containing a fluid and has an inlet and an outlet. The inlet is for the fluid to flow into the outer box. The fluid contained in the outer box is water or oil. The outlet is for the fluid to flow out of the outer box. The inner box places inside the outer box for containing a loading body and is suspended in the fluid. The connecting element such as cable or steel rope is wound around the sheave. The power output unit drives the sheave. An end of the connecting element is connected to the outer box, and the other end of the connecting element is connected to the counterweight. Most of all, the weight of the counterweight is equal to the total weight of the outer box, the fluid, the inner box and the maximal loading body.

Said elevating mechanism further includes a first fluid tank and a second fluid tank. The position of the first fluid tank is higher than the outer box, and the first fluid tank is connected to the inlet of the outer box. The position of the second fluid tank is lower than the outer box, and the second fluid tank is connected to the outlet of the outer box.

In another aspect, the invention provides a Ferris wheel using said elevating mechanism. The Ferris wheel includes a first cage, a second cage and a wheel connecting element. The structure of the first cage and the second cage is as said, and the weight of the second cage is equal to the total weight of the outer box, the fluid, the inner box and the maximal loading body of the first cage. Then, the second cage is regarded as the counterweight of the first cage. The wheel connecting element is connected between the first cage and the second cage. The sheave is disposed at the center of the wheel connecting element.

Because the weight of the counterweight equals the weight of the cage, the power output unit supplies the minimum power to make the invention achieve the most frugal state, and the cage runs according to the transmitting direction of the motor to solve the problem of rush when brake failure.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The present invention will now be specified with reference to its preferred embodiment illustrated in the drawings, in which.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component facing "B" component directly or one or more additional components is between "A" component and "B" component. Also, the description of "A" component "adjacent to" "B" component herein may contain the situations that "A" component is directly "adjacent to" "B" component or one or more additional components is between "A" component and "B" component. Accordingly, the drawings and descriptions will be regarded as illustrative in nature and not as restrictive.

Figure 1:
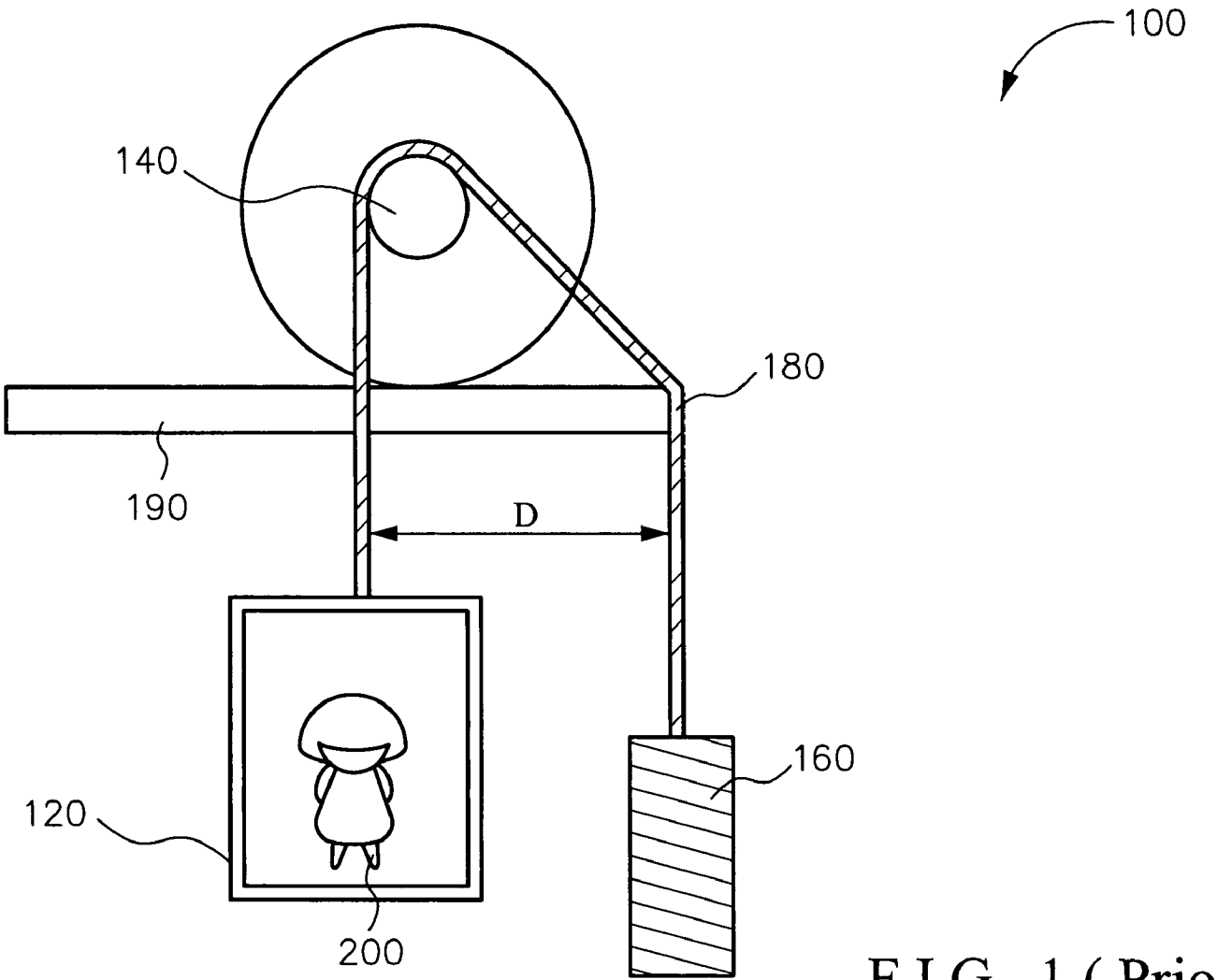
FIG. 1 (Prior Art)
FIG. 1 is a schematic view of the conventional elevating mechanism.
Figure 2:
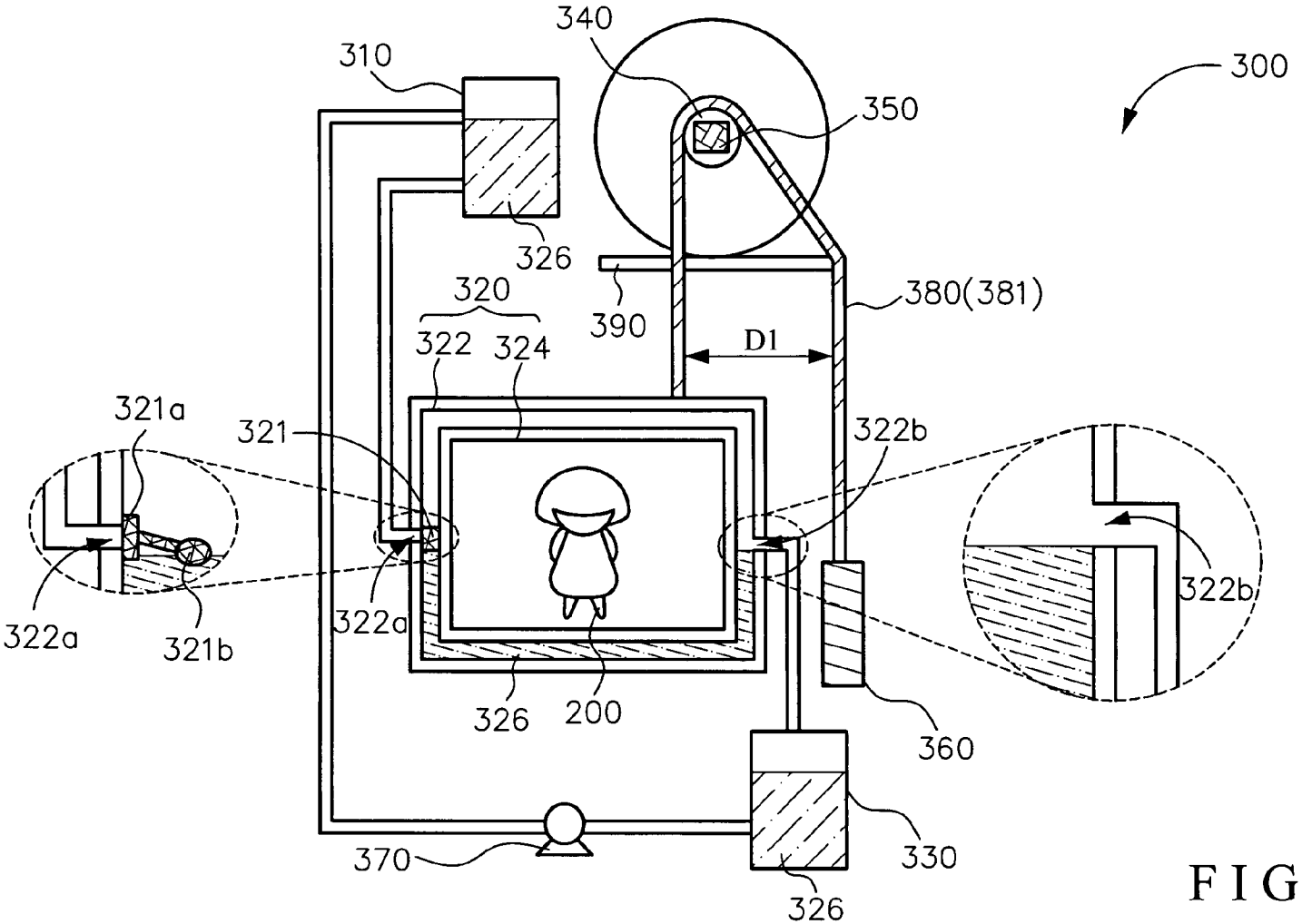
FIG.2 is a schematic view of the elevating mechanism of the present invention.

Refer to FIG. 2 for the first embodiment of invention, an elevating mechanism 300 includes a cage 320, a sheave 340, a power output unit 350, a counterweight 360 and a connecting element 380.

The cage 320 has an outer box 322 and an inner box 324. The outer box 322 is for containing a fluid 326 such as water or oil. The outer box 322 has an inlet 322*a* and an outlet 322*b*, wherein the inlet 322*a* is for the fluid 326 to flow into the outer box 322 and the outlet 322*b* is for the fluid 326 to flow out of the outer box 322. The inner box 324 places inside the outer box 322 for containing a loading body 200 and is suspended in the fluid 326.

In the first embodiment, the connecting element 380 is such as a cable 381. The cable 381 is wound around the sheave 340, and two ends of the cable 381 separately hang down from two sides of the sheave 340. One end of the cable 381 is connected to the outer box 322, and the other end of the cable 381 is connected to the counterweight 360. The power output unit 350 is connected to the sheave 340, and the sheave 340 is driven by the power output unit 350.

Therefore, the elevating mechanism 300 usually has a support component 390 for supporting the sheave 340 and the cable 381. As FIG.2 showing, the support component 390 upholds the cable 381, which is disposed at right side of the sheave 340, to increase the distance D1 between two ends of the cable 381 separately at two sides of the sheave 340 and to avoid the cage 320 colliding with the counterweight 360 when the elevating mechanism 300 operating.

Different with the conventional, the present invention provides a counterweight auto-regulated mechanism to make the weight of the cage 320 and the stuffs therein and the weight of the counterweight 360 maintain the same in any situation. Namely the weight of the counterweight 360 is permanently equal to the total weight of the outer box 322, the fluid 326, the inner box 324 and the maximal loading body 200 of the cage 320.

The elevating mechanism further includes a first fluid tank 310 and a second fluid tank 330. The place of the first fluid tank 310 is higher than the outer box 322 and the first fluid tank 310 is connected to the inlet 322*a* of the outer box 322 via a tube (without tittles). The place of the second fluid tank 330 is lower than the outer box 322 and the second fluid tank 330 is connected to the outlet 322*b* of the outer box 322 via a tube (without tittles). There are a tube (without tittles) and a fluid delivery pump 370 disposed between the first fluid tank 310 and the second fluid tank 330. The fluid delivery pump 370 draws out the fluid from the second fluid tank 330 into the first fluid tank 310.

Because the inner box 324 is suspended in the fluid of the outer box 322, the weight of the fluid 326 overflowing the outer box 322 is equal to the weight of the loading body 200 when the loading body 200 is disposed in the inner box 324. Therefore, by adjusting the waterline of the fluid 326 in the outer box 322, the weight of the counterweight 360 is equal to the total weight of the outer box 322, the fluid 326, the inner box 324 and the maximal loading body 200 of the cage 320. For instance, when the weight of the loading body is M (KG), the weight of the fluid overflowing the outer box into the lower second fluid tank 330 is M (KG). So the cage 320 still keep the original weight.

In an embodiment, the power, supplied by the power output unit 350, is (|M−500|+A)*P(KW/KG), where M denotes the weight (KG) of the loading body 200, A denotes the friction (KG) of the sheave 340, and P denotes the power (KW) consumed with per kilogram(KG). Hence, the power, supplied by the power output unit 350, invariably is A*P(KW/KG), and the power output unit 350 keeps the most frugal state.

Assuming that the inner box 324 is vacant, by controlling the fluid valve 321, the higher first fluid tank 310 automatically supplies the fluid 320 into the outer box 322 to get the full water line and then automatically stops supplying. As FIG. 2 showing, the fluid valve 321 includes a clog 321*a* and a float 321*b* and is disposed at the inlet 322*a* of the outer box 322. When the waterline is lower than the designed waterline in the outer box 322, the position of the float 321*b* following the waterline drops down to make the clog 321*a* depart from the inlet 322*a* and then the fluid 326 flows into the outer box 322.

In an embodiment, the waterline in the outer box 320 is passively controlled, so the power or the other is useless. Nevertheless, when the fluid in the first fluid tank 310 is not enough, the fluid in the second fluid tank 330 is drawn into the first fluid tank 310 by the waterline controller (without tittles) of the fluid valve 370. Therefore, the fluid 326 is able to be recycled and cut waste.

Figure 3:
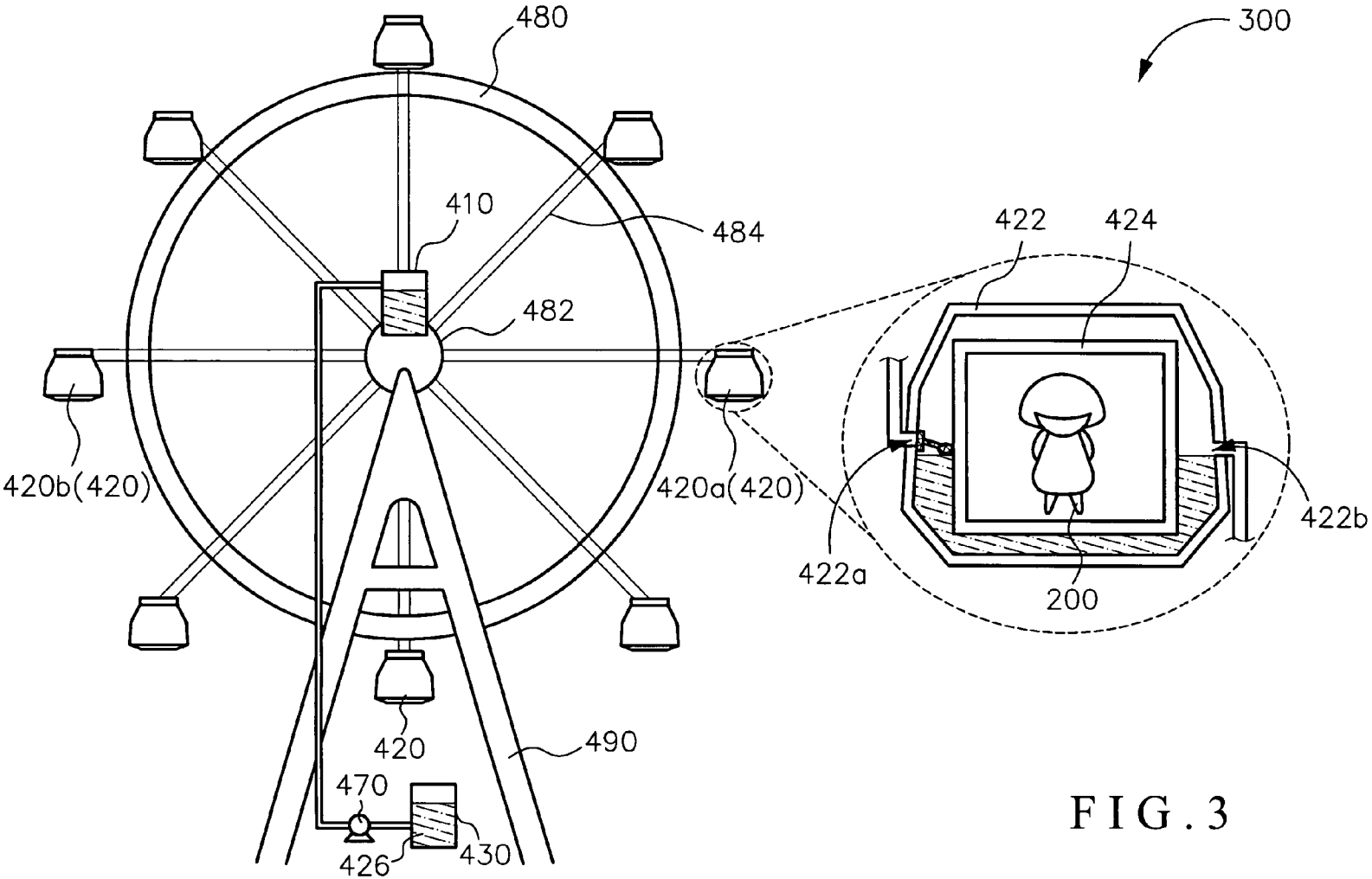
FIG. 3 is a schematic view of the Ferris wheel of the present invention.

In an embodiment, the connecting element is such as a steel rope 480. Refer to FIG. 3, the second embodiment of invention is a Ferris wheel 400 using said elevating mechanism 300. The Ferris wheel 400 includes a plurality of cages 420 suspended from a wheel steel rope 480. The wheel steel rope 480 is constituted of a rotating shaft 482 and a plurality of spokes 484. The rotating shaft 482 is placed at the center of whole wheel steel rope 480 and includes a sheave mechanism. The spokes 484 disposed are radial and at central rotating shaft 482. A first cage 420*a* and a second cage 420*b* are separately suspended from two ends of every spoke 484. The rotating shaft 482 is disposed on a foundation 490 and connected to a power output unit (without tittles). The power output unit supplies power to the rotating shaft 482 and the wheel steel rope 480 for rotating.

The structures of the first cage 420*a* and the second cage 420*b* are the same. Explain the structure of the cage 420 for instance of the first cage 420*a*. The cage 420 has an outer box 422 and an inner box 424. The model of the outer box 422 for containing a fluid 326 such as water or oil is a cable car. The outer box 422 has an inlet 422*a* and an outlet 422*b*. The inner box 424 places inside the outer box 422 for containing a loading body 200 and is suspended in the water.

In an embodiment, the weight of the second cage 420*b* is equal to the total weight of the outer box 422, the water 426, the inner box 424 and the maximal loading body 200 of the first cage 420*a*, so the second cage 420*b* is regarded as the counterweight of the first cage 420*a*.

The Ferris wheel 400 further includes a high reservoir 410 and a low reservoir 430. The weight of the loading body 200 of the cage 420 varies when the cage 420 rotates to the bottom, so the waterline should be revised. At the same time, the position of the cage 420 is lower than the high reservoir 410 and higher than the low reservoir 430. The water passing in and out is controlled to adjust the waterline by the high reservoir 410 connected to the inlet 422*a* of the outer box 422 and the low reservoir 430 connected to the outlet 422*b* of the outer box 422. For adjusting the waterline, there are a tube and a fluid delivery pump such as a suction pump 470 between the high reservoir 410 and the low reservoir 430. The suction pump 470 draws out the fluid from the low reservoir 430 into the high reservoir 410.

In the second embodiment, because the weight of the first cage 420*a* and the second cage 420*b* are the same, the power output unit supplies the minimum power to make the invention achieve the most frugal state, and the cage 420 runs according to the transmitting direction of the motor to solve the problem of rush when brake failure.

The fluid of said second embodiment is water 426. Nevertheless, the fluid is adopted as oil with applicable equipment such as tubes, fluid tanks and delivery pumps in the other embodiment.

Another advantage of the invention is that the other designed mechanisms except the fluid delivery pump 370 and the suction pump 470 are passive, quiet, safe, durable and power-saving. The operation of the fluid delivery pump 370 and the suction pump 470 is intermittent and just starts when the water is not enough. The fluid delivery pump 370 and the suction pump 470 are powered by solar generators or wind-driven generators to achieve complete renewable energy.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An elevating mechanism comprising:

an outer box, containing a fluid and having an inlet for the fluid to flow into the outer box and an outlet for the fluid to flow out of the outer box;

an inner box, disposed inside the outer box for containing a loading body and suspended in the fluid;

a connecting element, whose one end being connected to the outer box;

a counterweight, connected to the other end of the connecting element, and the weight of the counterweight equaling the total weight of the outer box, the fluid, the inner box and the loading body;

a sheave, for the connecting element wound around; and a power output unit, connected to the sheave.

2. The elevating mechanism of claim 1 further comprising a first fluid tank connected to the outlet of the outer box and a second fluid tank connected to the inlet of the outer box, wherein the position of the first fluid tank is higher than the outer box, and the position of the second fluid tank is lower than the outer box.

3. The elevating mechanism of claim 2 further comprising a fluid delivery pump connected between the first fluid tank and the second fluid tank.

4. The elevating mechanism of claim 1 further comprising a support component for supporting the sheave and the connecting element.

5. The elevating mechanism of claim 1, wherein the connecting element is a cable.

6. The elevating mechanism of claim 1, wherein the connecting element is a steel rope.

7. The elevating mechanism of claim 1, wherein the fluid contained in the outer box is water.

8. The elevating mechanism of claim 1, wherein the fluid contained in the outer box is oil.

9. The elevating mechanism of claim 1 further comprising a fluid valve disposed at the inlet of the outer box and having a clog and a float.

10. A Ferris wheel comprising:

a first cage, having an outer box and an inner box, wherein the outer box contains a fluid and has an inlet for the fluid to flow into the outer box and an outlet for the fluid to flow out of the outer box, and the inner box places inside the outer box for containing a loading body and is suspended in the fluid;

a wheel connecting element, whose one end being connected to the first cage;

a second cage, connected to the other end of the wheel connecting element and the weight of the second cage equaling the total weight of the outer box, the fluid, the inner box and the loading body;

a shaft, disposed at the center of the wheel connecting element; and a power output unit, connected to the shaft.

11. The Ferris wheel of claim 10 further comprising a first fluid tank connected to the outlet of the outer box and a second fluid tank connected to the inlet of the outer box, wherein the position of the first fluid tank is higher than the outer box, and the position of the second fluid tank is lower than the outer box.

12. The Ferris wheel of claim 11 further comprising a fluid delivery pump connecting the first fluid tank and the second fluid tank.

13. The Ferris wheel of claim 10 further comprising a support component for supporting the shaft and the wheel connecting element.

14. The Ferris wheel of claim 10, wherein the wheel connecting element is a wheel steel rope.

15. The Ferris wheel of claim 10, wherein the fluid contained in the outer box is water.

16. The Ferris wheel of claim 10, wherein the fluid contained in the outer box is oil.

17. The Ferris wheel of claim 10, wherein the shaft includes a sheave mechanism.

18. The Ferris wheel of claim 10, wherein the first cage has a fluid valve, disposed at the inlet of the outer box of the first cage and having a clog and a float.

* * * * *